US006676792B1

(12) United States Patent
Fenzi

(10) Patent No.: US 6,676,792 B1
(45) Date of Patent: Jan. 13, 2004

(54) PROCESS FOR DECORATING SECTIONS MADE OF METAL, PLASTIC MATERIAL OR THE LIKE, AND RELATED APPARATUS

(75) Inventor: Giancarlo Fenzi, Cazzano di Tramigna (IT)

(73) Assignee: Verniciatura Industriale Veneta S.p.A., Cazzano di Tramigna VR (IT)

( * ) Notice: Subject to any disclaimer, the term of this patent is extended or adjusted under 35 U.S.C. 154(b) by 0 days.

(21) Appl. No.: 09/242,994

(22) PCT Filed: Aug. 12, 1997

(86) PCT No.: PCT/EP97/04377

§ 371 (c)(1),
(2), (4) Date: Feb. 26, 1999

(87) PCT Pub. No.: WO98/08694

PCT Pub. Date: Mar. 5, 1998

(30) Foreign Application Priority Data

Aug. 28, 1996 (IT) ..... MI96A 1793

(51) Int. Cl.[7] ..... B44C 1/165

(52) U.S. Cl. ..... 156/240; 156/219; 156/209; 156/237; 156/239; 156/244.24

(58) Field of Search ..... 156/219, 209, 156/238, 239, 240, 237, 244.24; 264/211.12

(56) References Cited

U.S. PATENT DOCUMENTS 4,818,589 A * 4/1989 Johnson et al. ..... 428/201
5,203,941 A * 4/1993 Spain et al. ..... 156/209
5,284,693 A * 2/1994 Spain et al. ..... 428/172
5,506,031 A * 4/1996 Spain et al. ..... 428/172

FOREIGN PATENT DOCUMENTS

| | | |
|---|---|---|
| EP | 0230364 | * 7/1987 |
| EP | 0625433 | * 11/1994 |
| WO | 9105660 | * 5/1991 |

* cited by examiner

*Primary Examiner*—Merrick Dixon
(74) *Attorney, Agent, or Firm*—Collard & Roe, P.C.

(57) ABSTRACT

Process for variously decorating sections made of plastic materials, composite materials and the like, comprising a step of pre-treatment for the preparation of the surface, a possible step of pre-painting, a possible step of pre-heating, a step of decoration by transfer from a strip-like flexible support unwinding continuously from a first coil through the action of at least a rotating nip roll, suitably shaped, heated and thermostated, and lastly a possible step of sublimation and fixing, to obtain the transfer of the decoration and the polymerization of colors. Apparatus for the formation of the decoration, comprising a first coil from which a flexible support unwinds at least a rotating nip roll, shaped according to the section to be decorated, heated and thermostated, and at least a second coil for the rewinding of the flexible strip, once the decoration layer and the protection layer have been removed.

11 Claims, 1 Drawing Sheet

Figure 1:
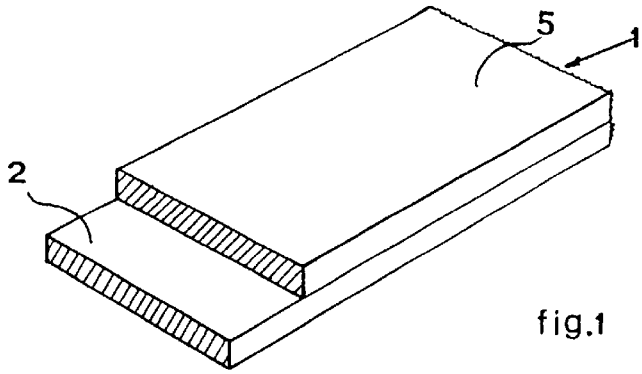

PROCESS FOR DECORATING SECTIONS MADE OF METAL, PLASTIC MATERIAL OR THE LIKE, AND RELATED APPARATUS

The present invention relates to a process for the decoration of sections from metals, plastic materials, composite materials, and the like, with geometric, floral, imitation wood or imitation marble pattern, and the like, either in one or more colours.

The present invention also relates to an apparatus suitable to realise said process.

As is known, sections intended for use in building components, such as doors and windows, curtain walls, balconies, handrails, town-fittings and the like, must have a high resistance against ageing and overcome several tests according to national and international norms and/or the provisions of the quality mark directives for the products to be used in architecture.

There has been realised a process for the production of large-size, variously decorated sections, which was the subject matter of the International Patent application PCT/EP96/00656, filed on Feb. 15, 1996 by the same applicant Verniciatura Industriale Veneta S.p.A; the process comprises the steps of winding of the artefact, previously subject to a surface treatment of pre-painting, anodic oxidation and the like, in a transfer support carrying the wished decoration; covering the section wrapped in the support with a membrane from rubber or the like; vacuum formation by means of suitable ducts between the membrane and the section wrapped in the support, on prior interposition of means suitable to ensure air flow and outlet, so as to cause the support to closely adhere to the shape of the artefact, and complying means suitable to obtain the uniformity of the pressure exercised by the membrane; and lastly heating the whole so as to obtain the transfer of the pattern and the polymerisation of colours. Therefore, the process is rather complex and delicate and requires also a high manpower use, in particular to realise the windings of the artefact in the transfer support, in the means suitable to ensure air outlet in the vacuum creation step, and the permanently complying means to obtain a uniform pressure.

Object of this invention is to provide a process allowing to obtain large size sections having a length of up to 20 m, variously decorated, to be used for the production of doors and windows, also for outdoor use, having the requirements of quality, weatherproofing and resistance to ageing, provided for by the different international norms and by quality marks.

A further object of this invention is to provide a process for the realisation of sections, in particular from metal, aluminium an aluminium alloys, plastic materials, composite materials (such as resins reinforced with carbon and or glass fibres and the like) provided with decorations in one or more colours, such as geometric, floral, imitation wood, imitation marble decorations, and also decorations comprising very complex patterns, exempt from defects such as deformations of pattern edges, smears, diffusion and superposition of colours and the like, and using a highly mechanised process with a low manpower need.

Still a further object of the invention is to provide an apparatus suitable for realising said process for the decoration of said sections.

These and still further objects and related advantages which will become apparent from the following description are achieved by a process for variously decorating sections from metal, plastic materials, composite materials and the like, which process, according to the present invention, comprises the following steps:

pre-treatment, i.e. submitting the sections to at least an operation of surface preparation, such as degreasing, cleaning, anodic oxidation, neutralisation, chromate treatment, phosphochromate treatment, phosphating, nitrocobalt treatment, treatment with chrome-free products and the like, mechanical polishing and the like, possible pre-painting, i.e. application on the surface of said sections submitted to said pre-treatment of at least a paint layer, using fluid or powder paints, realising in this way a priming, possible pre-heating, i.e. submitting said pre-painted sections to heating at a temperature of 50–200° C., decoration, i.e. application, on the surface of said pre-treated and possibly pre-painted and pre-heated sections, of a decoration by transfer from a strip-like flexible support developing from at least a first coil, through the action of temperature and/or pressure generated by at least a rotary nip roller from elastically complying and suitably shaped, heated and thermostated material, possible sublimation and fixing, i.e. submitting to heating said sections comprising said decoration, at a temperature of between 100 and 300° C. for 1 to 30 minutes, to obtain the transfer of the decoration and/or the pattern and the polymerisation of colours.

In case of sections from plastic materials, composite materials and the like, said pre-painting step is not always necessary, as the surface of said sections may be of a prefixed colour which acts as a primer for the decoration.

By said pre-painting, if any, there is obtained on the section the basic colour wished, and besides there are obtained one or more priming protection layers suitable to prevent phenomena of diffuision, smears and the like of the substances and colours used in the decoration step, obtaining in this way the highest sharpness of the patterns, avoiding the danger of colour diffusion and superposition, and ensuring the best quality of the same decoration as well as its duration in the time and its weatherproofing.

According to an embodiment of the present invention, said decoration is applied on the surface of said pre-treated and possibly pre-painted and pre-heated section, by means of a thin layer of glue, which co-operates with said temperature and/or pressure action, and contributes to fixing the decoration.

According to another embodiment of the present invention, a transparent, decoration-protecting paint layer is applied on said decoration applied to the surface of said pre-treated and possibly pre-painted and pre-heated section, always through the co-operation of said temperature and/or pressure action.

After said possible sublimation and fixing step, the decorated section according to the process subject matter of this invention may be submitted to a further protection treatment by means of the application of a transparent, possibly fluid paint and subsequent air—, hot air-, UV- or IR radiation oven drying.

Said strip-like flexible support is constituted, according to this invention, by a continuous strip from paper, fabric, plastic materials or the like, carrying the pattern to be transferred on the side which will get in touch with the surface of the section to be decorated.

According to another embodiment of the present invention, said strip-like flexible support is constituted by a continuous strip from paper, fabric, plastic materials or the like, carrying on the side which will get in touch with the surface of the section to be decorated a first thin layer of glue and a second layer constituted by the decoration or the pattern to be transferred.

According to a further embodiment of the present invention, said strip-like flexible support is constituted by a continuous strip from paper, fabric, plastic materials or the like, carrying on the side which will get in touch with the surface of the section to be decorated a first thin layer of glue, a second layer constituted by the decoration or the pattern to be transferred, and a third layer constituted by a transparent, decoration-protecting film.

For instance, there has proved to be particularly advantageous a strip-like flexible support produced by the firm Miroglio Tessile, Strada Tagliata 18, Alba (CN), Italy.

The decoration is automatically applied, through the combined action of heat and pressure, on the section to be decorated during its translation on a horizontal plane (on chain or rollers). The decoration is transferred on a strip from paper, fabric, plastic materials or the like, continuously pressed by a rotary nip roller from silicon material, on the surface of the section. The roller is suitably heated by a casing provided with electric resistors. Such temperature is kept carefully constant and controlled by electronic means. When the decoration is associated to a glue layer and/or a protecting paint layer, also these layers are transferred onto the section by a single rolling.

Sections from deformable materials (plastic materials, composite fibreglass-reinforced materials, etc.) or sections from metal having easily bruisable or damageable areas (low thicknesses, cantilever-flanges, etc.) may also be decorated on prior reinforcement of the delicate areas by means of suitable pads (from wood, plastic materials, metals, etc.).

According to the complexity of the section to be decorated several rollers may operate at the same time. Each of these rollers may be suitably inclined to work in a well defined area of the section's cross-section, and it will be shaped according to the same shape as the partly decorated area.

After the transfer step, the decoration-comprising strip from paper, fabric or plastic material is automatically recovered through a system of unwinding and rewinding coils. After the possible sublimation and fixing step, the whole cycle can be completed by the stay of the decorated sections in a ventilated air-, UV- or IR radiation oven. This step allows to achieve the ideal conditions to perform the complete sublimation of the decoration inks on the surface of the sections and their complete fixing. Sections remains in the oven for a time comprised between 1 and 30 minutes at temperatures comprised between 100 and 300° C.

The process according to the invention proved particularly advantageous to obtain sections from aluminium alloy with imitation wood or imitation marble decorations, comprising a first layer of primer forming the basic colour, and a second layer constituted by the decoration. Besides, according to the final use of the sections, there may be included a third layer constituted by a veil of decoration-protecting paint.

Figure 2:
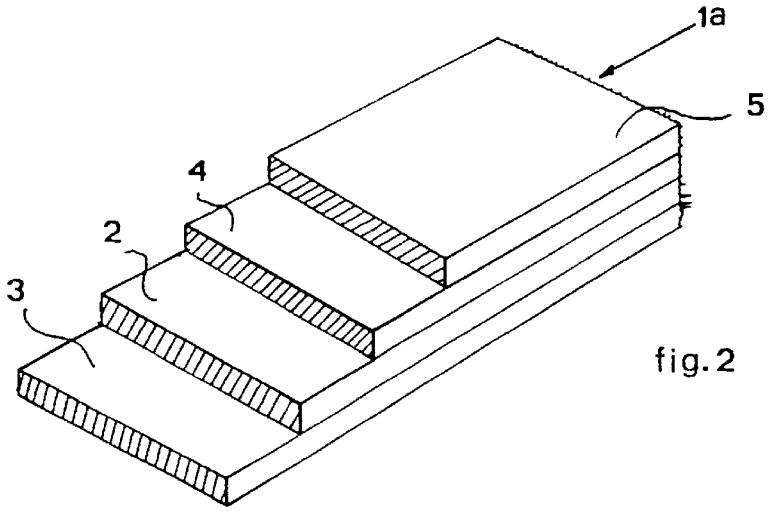
Figure 3:
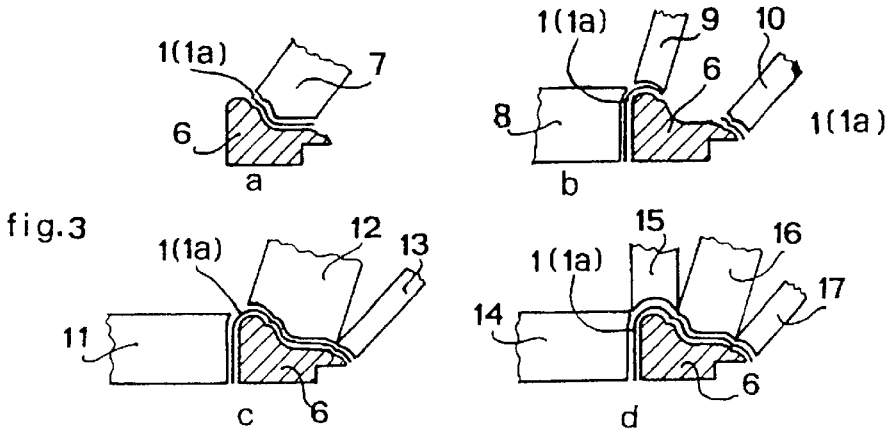

The invention will be described hereunder with reference to the attached drawing, given by way of non limiting illustration of the same invention, wherein:

FIG. 1 shows schematically a type of strip-like flexible support according to the invention, FIG. 2 shows schematically another type of strip-like flexible support, FIG. 3 shows, always schematically, the realisation of the decoration step according to the invention, by using either only one rotary nip roller (a) or several nip rollers (b, c and d).

With reference to such figures, the strip-like flexible support 1 is constituted by a disposable continuous strip 5 from paper, fabric, plastic materials or the like, carrying the decoration to be transferred 2. According to an embodiment of the present invention, the strip-like flexible support 1*a* is constituted always by the disposable strip 5 carrying the decoration to be transferred 2 provided, on its surface facing the surface of the section to be decorated, a glue layer 3 which facilitates the adhesion of the decoration layer obtained with special sublimable organic inks and, on the opposite surface, by a thin veil of transparent paint 4 whose function is the protection of the underlying decoration 2.

The flexible layer 1 or 1*a*, continuously developing from a coil or the like (not shown) is pressed, with the surface carrying the decoration or the glue facing the surface of the section to be decorated 6, schematically shown in cross-section, by means of the shaped rotary nip rollers 7–17. As said, such rollers are suitably heated and thermostated. The combined action of heat and pressure, generated by the nip rollers, possibly helped by the action of glue 3, causes the adhesion of the layer constituted by the decoration or the layers constituted by the decoration coupled with the protecting paint to the surface to be decorated of section 6 which translates longitudinally on a horizontal plane under the suitably shaped rotary nip rollers. The strip from paper, fabric, plastic materials, without the glue, decoration and possible protection paint layers, is then rewound on a second rewinding coil, while the coated section goes on to the subsequent step of sublimation and fixing in an air circulation-, IR- or UV oven or the like.

To sum up, tha apparatus suitable to realise the decoration step according to this invention comprises:

- a section to be decorated translatable on a plane in the direction of its longitudinal axis,
- at least a first coil on which there is wound up and from which there unwinds a strip-like flexible support comprising a strip from paper, fabric or plastic materials, a layer constituted by the decoration to be transferred and possibly a glue layer and/or a transparent protection paint layer or film,
- at least a rotary nip roller, elastically complying, shaped according to the profile of the section to be decorated, heated and thernostated, suitably to transfer by heating and/or pressure action, the layer constituted by the decoration and possibly the protecting paint layer on the surface of the section,
- at least a second coil on which the strip from paper, fabric or plastic materials is rewound, once the decoration and protection layers have been removed.

What is claimed is:

1. A process for variously decorating sections from metal, plastic materials, and composite materials which comprises the following steps:

- pre-treating by submitting the sections to at least one step of surface preparation selected from the group consisting of degreasing, cleaning, anodic oxidation, neutralization, chromate treatment, phosphochromate treatment, phosphating, nitrocobalt treatment, treatment with chrome-free products and mechanical polishing; and
- decorating by applying onto a surface of said pre-treated sections, a decoration by sublimation transfer from a strip-like flexible support developing from at least a first coil, through the action of temperature and pressure generated by at least a rotary nip roller from elastically complying and suitably shaped, heated and thermo-stated material, said rotary nip roller being made from silicon material, said roller being suitable inclined in a well defined area of the section to be decorated and being shaped according to the same shape as the decorated area.

2. The process according to claim 1, further comprising the following steps:

pre-painting, by applying onto the surface of said sections submitted to said pre-treating of at least a paint layer, using a paint selected from the group consisting of fluid paint and powder paint, realizing in this way a priming;

pre-heating by submitting said pre-painted sections to heating at a temperature of 50°–200° C.; and fixing by submitting said pre-painted sections comprising said decoration, at a temperature of between 100° C. and 300° C. for 1 to 30 minutes.

3. The process according to claim 1, comprising applying said decoration to the surface of said pre-treated sections by means of a thin layer of glue, which co-operates with said temperature and pressure action and contributes to the fixing of said decoration.

4. The process according to claim 1, comprising applying a layer of transparent decoration-protecting layer onto said decoration to the surface of said pre-treated sections, always by means of the combined action of temperature and pressure.

5. The process according to claim 1, comprising submitting said sections, after said decorating by said sublimation step and said possible fixing step, to a further protection treatment, through the application of a transparent paint and subsequent drying selected from the group consisting of air-drying, hot air-drying, UV radiation, and IR radiation oven drying.

6. The process according to claim 5, wherein said transparent paint is a fluid paint.

7. The process according to claim 1, wherein said strip-like flexible support is constituted by a continuous strip of material selected from the group consisting of paper, fabric, and plastic material; and carrying the decoration or the pattern to be transferred on the side that will get in touch with the surface of the section to be decorated.

8. The process according to claim 1, wherein said strip-like flexible support is constituted by a continuous strip of material selected from the group consisting of paper, fabric, and plastic material; and carrying on the side that will get in touch with the surface of the section to be decorated a first thin layer of glue and a second layer constituted by the decoration or the pattern to be transferred.

9. The process according to claim 1, wherein said strip-like flexible support is constituted by a continuous strip of material selected from the group consisting of paper, fabric, and plastic material; and carrying on the side that will get in touch with the surface of the section to be decorated a first thin layer of glue, a second layer constituted by the decoration or the pattern to be transferred and a third layer constituted by a transparent, decoration protecting film.

10. The process according to claim 1, wherein said strip-like flexible support is a disposable strip.

11. The process according to claim 1, wherein the sections from deformable plastic materials, and composite materials and the sections that have easily deformable areas are decorated on prior reinforcement of the delicate areas by means of suitable pads made from a material selected from the group consisting of wood, plastic material and metal.

* * * * *